US009213253B2

(12) United States Patent
Suzuki

(10) Patent No.: US 9,213,253 B2
(45) Date of Patent: Dec. 15, 2015

(54) IMAGE FORMING APPARATUS HAVING IMAGE CARRIER AND BELT MEMBER

(71) Applicant: CANON KABUSHIKI KAISHA, Tokyo (JP)

(72) Inventor: Shinya Suzuki, Toride (JP)

(73) Assignee: CANON KABUSHIKI KAISHA (JP)

( * ) Notice: Subject to any disclaimer, the term of this patent is extended or adjusted under 35 U.S.C. 154(b) by 0 days.

(21) Appl. No.: 14/103,910

(22) Filed: Dec. 12, 2013

(65) Prior Publication Data

US 2014/0169804 A1 Jun. 19, 2014

(30) Foreign Application Priority Data

Dec. 17, 2012 (JP) ..... 2012-274576

(51) Int. Cl.
*G03G 15/08* (2006.01)
*G03G 15/01* (2006.01)
*G03G 15/00* (2006.01)

(52) U.S. Cl.
CPC ..... *G03G 15/0136* (2013.01); *G03G 15/553* (2013.01); *G03G 15/751* (2013.01)

(58) Field of Classification Search
CPC ..... G03G 2221/1606; G03G 15/751; G03G 21/1671; G03G 15/0208; G03G 15/0258; G03G 15/5058; G03G 15/75; G03G 15/757; G03G 21/1628; G03G 2215/0116; G03G 2215/0129; G03G 2215/0141; G03G 2221/1651
See application file for complete search history.

(56) References Cited

U.S. PATENT DOCUMENTS

| | | | | |
|---|---|---|---|---|
| 5,325,157 | A * | 6/1994 | Takano | 399/26 |
| 8,064,797 | B2 | 11/2011 | Sugiyama | |
| 8,200,102 | B2 | 6/2012 | Zensai | |
| 2006/0002729 | A1 * | 1/2006 | Yoshizuka et al. | 399/55 |
| 2006/0222418 | A1 * | 10/2006 | Ebara et al. | 399/301 |
| 2010/0080625 | A1 * | 4/2010 | Furuya et al. | 399/121 |

FOREIGN PATENT DOCUMENTS

| | | | |
|---|---|---|---|
| JP | 2009-109584 | A | 5/2009 |
| JP | 2009-271270 | A | 11/2009 |

* cited by examiner

*Primary Examiner* — Roy Y Yi
(74) *Attorney, Agent, or Firm* — Rossi, Kimms & McDowell LLP

(57) ABSTRACT

An image forming apparatus which is capable of reducing downtime while preventing generation of friction between an image carrier and a belt member when the image carrier or the belt member is replaced. Whether or not a photosensitive drum should be replaced is determined based on usage conditions of the photosensitive drum, and when it is determined that the photosensitive drum should be replaced, a separating operation of separating an intermediate transfer belt from the photosensitive drum is carried out after an image formed on the intermediate transfer belt is transferred to a recording medium. When it is not determined that the photosensitive drum should be replaced, the separating operation is not carried out after the image formed on the intermediate transfer belt is transferred to the recording medium.

13 Claims, 8 Drawing Sheets

FULL ABUTMENT

ONE-COLOR ABUTMENT

FULL SEPARATION

*FIG. 6*

| OPERATION | ABUTMENT/SEPARATION STATE AT NORMAL TIME | ABUTMENT/SEPARATION STATE AT TIME OF REPLACEMENT | ABUTMENT/SEPARATION STATE AT ABNORMAL TIME |
|---|---|---|---|
| STANDBY | ONE-COLOR ABUTMENT (WHEN MONOCHROME HAS HIGH PRIORITY) FULL ABUTMENT (WHEN COLOR HAS HIGH PRIORITY) | FULL SEPARATION | FULL SEPARATION |
| MONOCHROME JOB | ONE-COLOR ABUTMENT | ONE-COLOR ABUTMENT | ONE-COLOR ABUTMENT |
| COLOR JOB | FULL ABUTMENT | FULL ABUTMENT | FULL ABUTMENT |

IMAGE FORMING APPARATUS HAVING IMAGE CARRIER AND BELT MEMBER

BACKGROUND OF THE INVENTION

1. Field of the Invention

The present invention relates to an image forming apparatus in which a toner image carried on an image carrier is transferred to a belt member, and in particular to an image forming apparatus whose image carrier or belt member is replaceable.

2. Description of the Related Art

Conventionally, image forming apparatuses having a photosensitive drum (image carrier) bearing a toner image, a transfer roller, and an intermediate transfer belt (belt member) have been known. At the time of image formation, the transfer roller is brought into an abutment state in which it is pressed against the photosensitive drum via the intermediate transfer belt, and a toner image formed on the photosensitive drum is transferred to the intermediate transfer belt. Some of those image forming apparatuses are configured such that the photosensitive drum or a unit including the same and the intermediate transfer belt or a unit including the same are replaceable independently of each other.

Also, some image forming apparatuses are configured to, in order to reduce waiting time during image formation, wait with the intermediate transfer belt and the photosensitive drum being in abutment with each other in a standby state in which it waits for a print job.

Tandem-type image forming apparatuses in which image forming units that develop yellow, magenta, cyan, and black colors are disposed along an intermediate transfer belt or a recording material conveyer are widely known as full-color image forming apparatuses. Some of those tandem-type image forming apparatuses wait on standby with all photosensitive drums or only a photosensitive drum for black color being kept in abutment with the intermediate transfer belt.

When the intermediate transfer belt unit or the photosensitive drum is replaced with the intermediate transfer belt unit and the photosensitive drum being kept in abutment with each other, friction may be generated between the intermediate transfer belt unit and the photosensitive drum, causing deterioration thereof due to wear or the like. Accordingly, as described below, there have also been disclosed techniques to separate the intermediate transfer belt unit and the photosensitive drum from each other when replacing the intermediate transfer belt unit or the photosensitive drum.

Japanese Laid-Open Patent Publication (Kokai) No. 2009-271270 discloses a technique that has a mode for separating the intermediate transfer belt and the photosensitive drum from each other and detects a state of separation between them. Japanese Laid-Open Patent Publication (Kokai) No. 2009-109584 discloses a technique that, at the time of replacing the intermediate transfer belt unit, manually moves a lever to separate the intermediate transfer belt and the photosensitive drum from each other.

According to the above prior arts, however, there may be cases where the intermediate transfer belt or the photosensitive drums is replaced without separating the intermediate transfer belt and the photosensitive drum from each other due to an operation error, a mistake, or the like, causing deterioration thereof due to friction.

Moreover, manually separating the intermediate transfer belt and the photosensitive drum from each other will increase the number of mechanical components, resulting in cost increase.

On other hand, in order that the intermediate transfer belt or the photosensitive drum can be replaced in a state where the intermediate transfer belt and the photosensitive drum are reliably separate from each other, there may be an arrangement in which the intermediate transfer belt and the photosensitive drum are always kept separate from each other in preparation for replacement. With this arrangement, however, whenever image formation is started, the intermediate transfer belt and the photosensitive drum are brought into abutment with each other, and hence waiting time during image formation cannot be shortened, and the start of image formation is late. Namely, there is downtime due to abutment each time, resulting in poor merchantability.

SUMMARY OF THE INVENTION

The present invention provides an image forming apparatus which is capable of reducing downtime while preventing generation of friction between an image carrier and a belt member when the image carrier or the belt member is replaced.

Accordingly, a first aspect of the present invention provides an image forming apparatus comprising a photosensitive drum, an image forming unit configured to form an image on the photosensitive drum, an intermediate transfer belt, a transfer unit configured to transfer the image formed on the photosensitive drum to the intermediate transfer belt, and transfer the image on the intermediate transfer belt to a recording medium, a determination unit configured to determine whether it is necessary to replace the photosensitive drum based on usage conditions of the photosensitive drum, and a separation unit configured to perform a separating operation for separating the intermediate transfer belt from the photosensitive drum, wherein, in a case where the determination unit determines that the photosensitive drum should be replaced, the separation unit is configured to perform the separating operation after the image on the intermediate transfer belt is transferred to the recording medium by the transfer unit, and in a case where the determination unit does not determine that the photosensitive drum should be replaced, the separation unit is configured not to perform the separating operation.

According to the present invention, downtime is reduced while generation of friction between the image carrier and the belt member is prevented when the image carrier or the belt member is replaced.

Further features of the present invention will become apparent from the following description of exemplary embodiments (with reference to the attached drawings).

BRIEF DESCRIPTION OF THE DRAWINGS

FIG. 6 is a diagram showing the correspondence relationship between the operating state of the image forming apparatus and the state of the photosensitive drums (or primary transfer rollers) being in abutment with and separate from the intermediate transfer belt.

DESCRIPTION OF THE EMBODIMENTS

The present invention will now be described with reference to the drawings showing an embodiment thereof.

Figure 1:
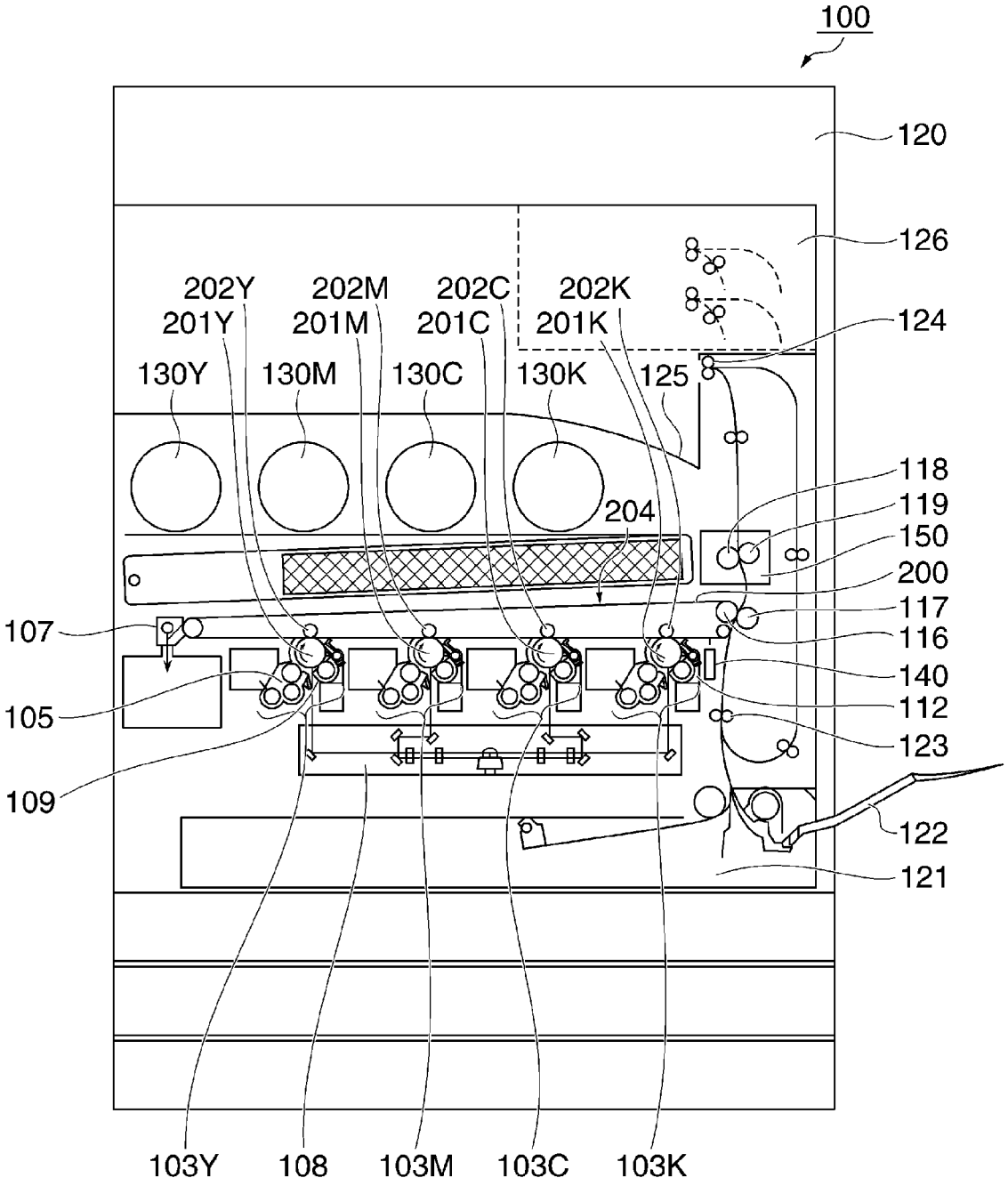
FIG. 1 is a cross-sectional view schematically showing an arrangement of an image forming apparatus according to an embodiment of the present invention.

FIG. 1 is a cross-sectional view schematically showing an arrangement of an image forming apparatus according to the embodiment of the present invention.

As an example of this image forming apparatus 100, a multi-color or full-color electrophotographic image forming apparatus integrated with a developer containing device to which a developer container containing developers (hereafter referred to as "toners") replenishing a developing device is attachable is illustrated. In particular, the image forming apparatus 100 is an inline-type image forming apparatus in which a plurality of process cartridges is arranged in a line.

Specifically, the image forming apparatus 100 has removable process cartridges 103 (103Y, 103M, 103C, and 103K) arranged at regular intervals in a substantially horizontal straight line. The process cartridges 103Y, 103M, 103C, and 103K form images of yellow (Y), magenta (M), cyan (C), and black (K) colors, respectively. In the following description, component elements corresponding to the respective colors are designated by the same reference symbols when they are not distinguished by color, and alphabets "Y", "M", "C", and "K" are added to ends of the reference symbols when they are distinguished by color.

Photosensitive drums 201 (201Y, 201M, 201C, and 201K), which are drum type photosensitive members acting as image carriers, are placed in the respective process cartridges 103Y, 103M, 103C, and 103K. In an image forming operation, toner images of the respective colors formed on the photosensitive drums 201 are successively superposed on top of one another and primarily transferred to an intermediate transfer belt 200 which is a belt member, and then the toner images are secondarily transferred from the intermediate transfer belt 200 to a recording medium to form a color image.

A charger 109, a developing device 105, and a drum cleaner unit 112 are disposed around each of the photosensitive drums 201. At such locations as to face the photosensitive drums 201 across the intermediate transfer belt 202, primary transfer rollers 202 (202Y, 202M, 202C, and 202K) are disposed correspondingly to the respective photosensitive drums 201. A laser exposure device 108 is placed below the process cartridges 103.

The laser exposure device 108 has a laser emission unit that emits light corresponding to a time-series electric digital pixel signal for supplied image information. Between the chargers 109 and the developers 105, the laser exposure device 108 exposes the photosensitive drums 201 to light, thereby forming electrostatic latent images of the respective colors corresponding to image information on surfaces of the respective photosensitive drums 201 electrically charged by the respective chargers 109.

The photosensitive drums 201, which are negatively-charged OPC photo conductors, each have a photoconductive layer on a drum substrate made of aluminum and are rotatively driven by a drive unit (not shown) at a predetermined process speed. The chargers 109 uniformly charge surfaces of the photosensitive drums 201 to a predetermined negative potential by a charging bias applied from a charging bias source (not shown). The developing devices 105, which have toners (developers) therein, attach toners of the respective colors to electrostatic latent images formed on the photosensitive drums 201 and develops (makes visible) the electrostatic latent images as toner images. The drum cleaner units 112, which have cleaning blades and others, remove post-transfer residual toner which remains on the photosensitive drums 201 after primary transfer.

An intermediate transfer belt unit 204 includes a tension roller 203 (FIGS. 3A to 3C), rollers such as a driving roller 116, and a gear (not shown) on the drive roller 116, as well as the intermediate transfer belt 200 and the primary transfer rollers 202. The drive roller 116 is rotatively driven by a drive gear, not shown, and as a result, the intermediate transfer belt 200 rotates counterclockwise as viewed in FIG. 1. The drive roller 116 doubles as a secondary transfer opposing roller.

The primary transfer rollers 202 are disposed inside the annular intermediate transfer belt 200 so as to be able to move and face the photosensitive drums 201 and disposed so as to be urged toward the corresponding photosensitive drums 201 by an urging mechanism, not shown. A secondary transfer roller 117 is disposed so as to face the drive roller 116 across the intermediate transfer belt 200. A fixing unit 150, which has a fixing roller 118 and a pressurizing roller 119, is placed in a longitudinal path configuration and downstream of the secondary transfer roller 117 in a direction in which a recording medium is conveyed.

In the image forming apparatus 100, toner containers (developer containers) 130 (130Y, 130M, 130C, and 130K) containing toners of the respective colors with which the respective developing devices 105 are to be replenished are removably mounted above the intermediate transfer belt unit 204.

A description will now be given of an image forming operation. When an original reading unit 120 reads an original and issues an image formation start signal, the photosensitive drums 201 of the respective process cartridges 103 rotatively driven at a predetermined process speed become negatively charged with uniformity by the respective chargers 109. The laser exposure device 108 then sends externally-input color-separated image signals from the laser emission unit and forms electrostatic latent images of the respective colors on the photosensitive drums 201.

Toners of the respective colors are then attached to the electrostatic latent images, which are formed on the photosensitive drums 201, by the developing devices 105 to which developing biases of the same polarity as the charging polarity (negative polarity) of the photosensitive drums 201 are applied, so that the electrostatic latent images are made visible as toner images. During primary transfer, primary transfer biases (of the polarity (positive polarity) opposite to that of the toners) are applied to the primary transfer rollers 202. At this time, the toner images on the photosensitive drums 201 are primarily transferred to the intermediate transfer belt 200, which is being driven, in a state where the primary transfer rollers 202 are being presses against the photosensitive drums 201 via the intermediate transfer belt 200.

This operation is carried out for the yellow, magenta, cyan, and black colors at the same time, and toner images of the respective colors are successively superposed on the intermediate transfer belt 200 to form full-color toner images on the intermediate transfer belt 200. Post-transfer residual toner remaining on the photosensitive drums 201 are scrapped off by cleaner blades or the like provided in the respective drum cleaner units 112 and then collected.

The full-color toner images on the intermediate transfer belt 200 are conveyed to a secondary transfer unit between the drive roller 116 and the secondary transfer roller 117. In accordance with the timing in which a leading end of the toner images moves to the secondary transfer unit, a recording medium such as a sheet fed from a feed cassette 121 or a manual feed tray 122 passes through a conveying path, which is substantially vertical, and is conveyed to the secondary transfer unit by register rollers 123. The full-color toner images are secondarily transferred in a collective manner to the recording medium, which has been conveyed to the secondary transfer unit, by the secondary transfer roller 117 to which secondary transfer biases (of the polarity (positive polarity) opposite to that of the toners) are applied. Residual toner remaining on the intermediate transfer belt 200 after the secondary transfer is scraped off by a post-transfer cleaning device 107 and conveyed and collected as collected toner.

The recording medium with the full-color toner images formed thereon is conveyed to the fixing unit 150 located downstream of the secondary transfer unit, and the full-color toner images are heated and pressurized by a fixing nip part between the fixing roller 118 and the pressurizing roller 119 and thermally fixed on a surface of the recording medium. The recording medium is then discharged onto a discharge tray 125 on an upper surface of a main body of the image forming apparatus 100 by first discharging rollers 124, and this completes the sequential image forming operation.

It should be noted that the image forming apparatus 100 is configured to be able to optionally have an additional discharging unit 126 above the first discharging rollers 124.

A photo-sensor 140 that detects position and density so as to detect a patch image formed on the intermediate transfer belt 200 is disposed below the intermediate transfer belt unit 204. The photo-sensor 140 irradiates the intermediate transfer belt 200 with light and detects reflected light from position detection patterns or density adjustment patterns formed on the intermediate transfer belt 200 by the photosensitive drums 201 to obtain density information or misregistration information.

Figure 2:
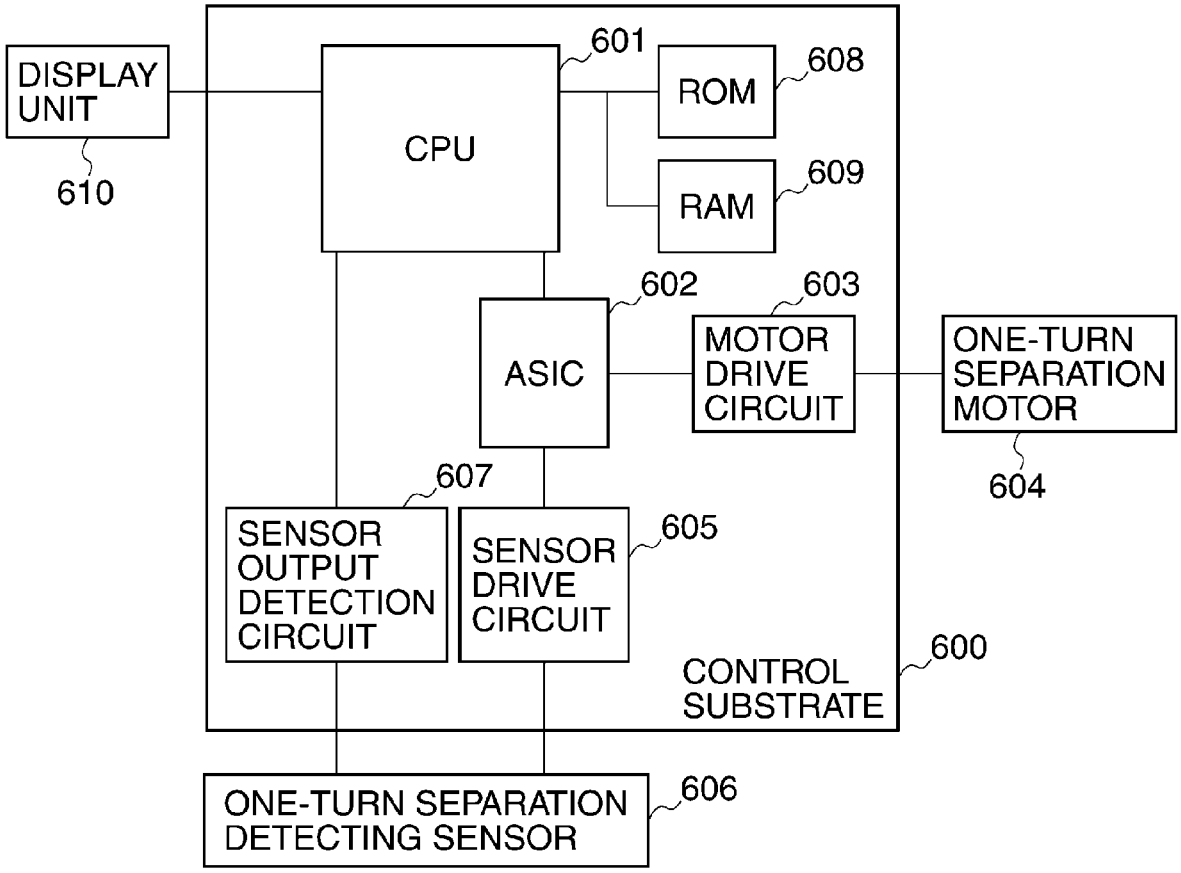
FIG. 2 is a block diagram showing a control system of the image forming apparatus.

FIG. 2 is a block diagram showing a control system of the image forming apparatus 100.

A CPU 601, RAM 609, ROM 608, and so on are included on a control substrate 600. When the intermediate transfer belt 200 and the photosensitive drums 201 are brought into contact with or separated from each other for the purpose of primary transfer, the CPU 602 causes an ASIC 602 and a motor drive circuit 603 to drive a one-turn separation motor 604. Control programs to be executed by the CPU 601 are stored in the ROM 608. The RAM 609 is used as a work area for the CPU 601.

The CPU 601 controls the one-turn separation motor 604 to change positions of the primary transfer rollers 202 and the tension roller 203 and realize desired abutment/separation states. To detect abutment/separation states, the CPU 601 sends signals to one-turn separation sensors 606 via the ASIC 602 and a sensor drive circuit 605. The one-turn separation sensors 606 are photo-sensors which are provided for the respective primary transfer rollers 202 and selectively allow light to pass and shield light according to positions of the corresponding primary transfer rollers 202. The one-turn separation sensors 606 emit light in response to a signal from the sensor drive circuit 605 and detects reflected light.

A sensor output detection circuit 607 detects a detection signal from the one-turn separation sensors 606 and sends the signal to the CPU 601. Based on the signal from the sensor output detection circuit 607, the CPU 601 determines whether the primary transfer rollers 202 are in abutment with or separate from the photosensitive drums 201 via the intermediate transfer belt 200. It should be noted that the arrangement of the sensors for detecting the positions of the primary transfer rollers 202 are not limited to one shown in the figure. A display unit 610, which is provided on an operation panel, not shown, displays a variety of information on a display screen, not shown.

A description will now be given of how the intermediate transfer belt 200 and the photosensitive drums 201 are brought into abutment with or separated from each other.

Figures 3A, 3B, 3C:
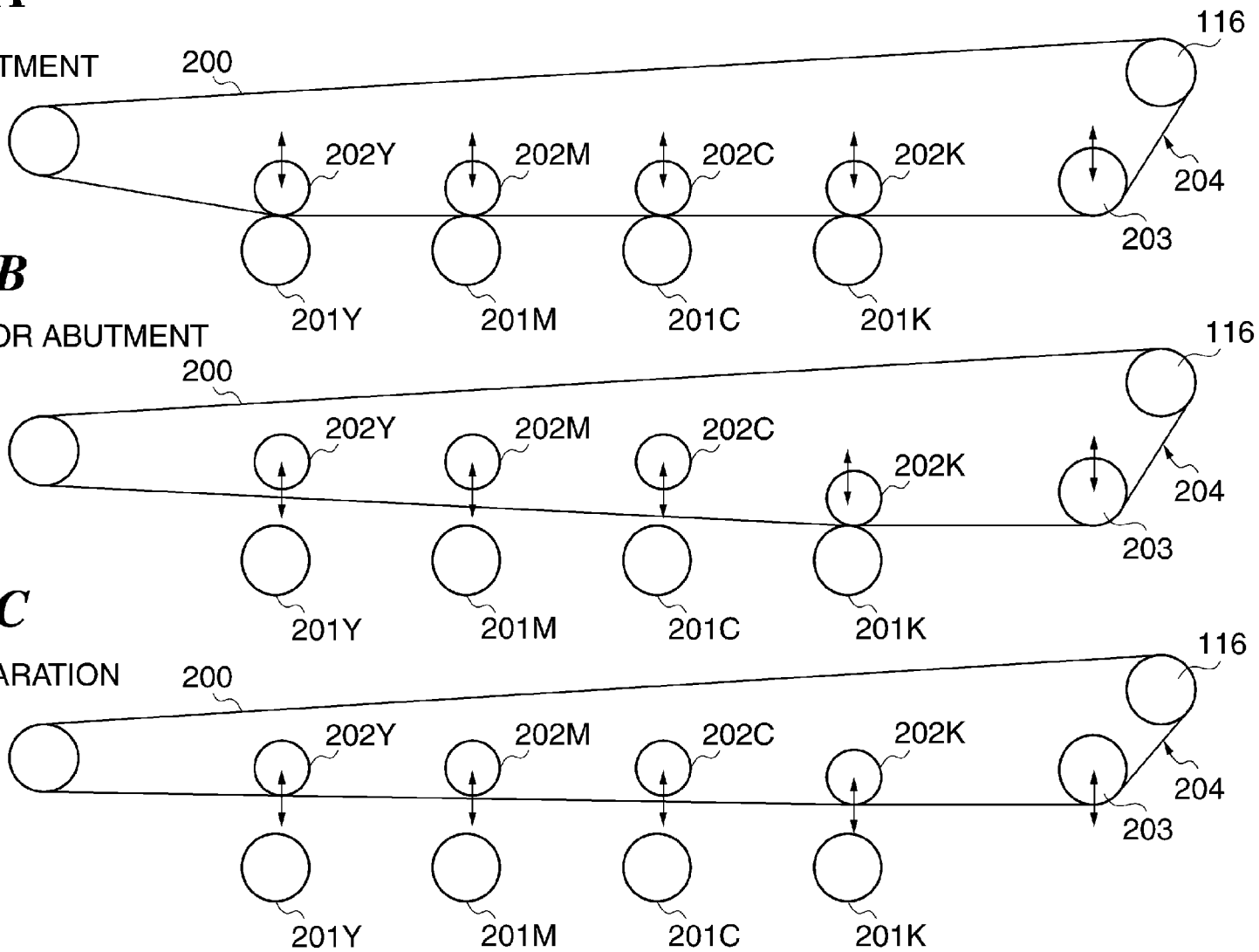
FIGS. 3A to 3C are views showing a full abutment state (FIG. 3A), a one-color abutment state (FIG. 3B), and a full separation state (FIG. 3C) in a case where an intermediate transfer belt and photosensitive drums are seen from directions of rotary shafts of the photosensitive drums.

FIGS. 3A to 3C are views of the intermediate transfer belt unit 204 and the photosensitive drums 201 as seen from directions of rotary shafts of the photosensitive drums 201, in which FIG. 3A shows a full abutment state, FIG. 3B shows a one-color abutment state, and FIG. 3C shows a full separation state.

The one-turn separation motor 604 (FIG. 2) drives the primary transfer rollers 202 and the tension roller 203 in directions indicated by respective arrows in FIGS. 3A to 3C. The primary transfer rollers 202 are urged against the corresponding photosensitive drums 201 by the urging mechanism as described above. Thus, by drive force from the urging mechanism and the one-turn separation motor 604, the primary transfer rollers 202 are displaced in such a direction as to become close to or separated from the corresponding photosensitive drums 201.

In the present embodiment, by the one-turn separation motor 604 (FIG. 6) changing positions of the primary transfer rollers 202 and the tension roller 203, the following three modes can be selected: a color mode (the full abutment state), a monochrome mode (the one-color abutment state), and a fully separated mode (the full separation state). At the time of image formation, the primary transfer rollers 202 are brought into the full abutment state or the one-color abutment state.

The color mode (the full abutment state) is a mode in which an image is formed by bringing all the photosensitive drums 201 into abutment with the intermediate transfer belt 200 and superposing all the four colors on top of one another. When a color image is to be formed, all the primary transfer rollers 202 come into abutment with the corresponding photosensitive drums 201 via the intermediate transfer belt 200 so that toner images formed on all the photosensitive drums 201 can be transferred to the intermediate transfer belt 200.

The monochrome mode (the one-color abutment state) is a mode in which only the photosensitive drum 201K for forming monochrome images is brought into abutment with the intermediate transfer belt 200 to form a monochrome (black) image. When a monochrome image is to be formed, only the primary transfer rollers 202K comes into abutment with the photosensitive drum 201K via the intermediate transfer belt 200. The other primary transfer rollers 202Y, 202M, and 202C are brought into the separation state in which they are not in abutment with the photosensitive drums 201Y, 201M, and 201C, which are for forming color images, via the intermediate transfer belt 200. As a result of this one-color abutment state, the photosensitive drums 201Y, 201M, and 201C, which are for forming color images, are separated from the intermediate transfer belt 200 and inhibited from rotating, so that deterioration thereof can be reduced.

In the full separation mode (full separation state), all the photosensitive drums 201 are separated from the intermediate transfer belt 200. This mode has the advantage that even when the intermediate transfer belt unit 204 or any of the photosensitive drums 201 is replaced, friction is not generated between the intermediate transfer belt 200 and the photosensitive drums 201.

As will be described with reference to FIGS. 4, 5A, and 5B, in the present embodiment, the intermediate transfer belt unit 204 and the photosensitive drums 201 are configured to be individually removable from the image forming apparatus 100. For example, when any of the intermediate transfer belt 200 and the photosensitive drums 201 has deteriorated, it can be replaced with a new one.

Figure 4:
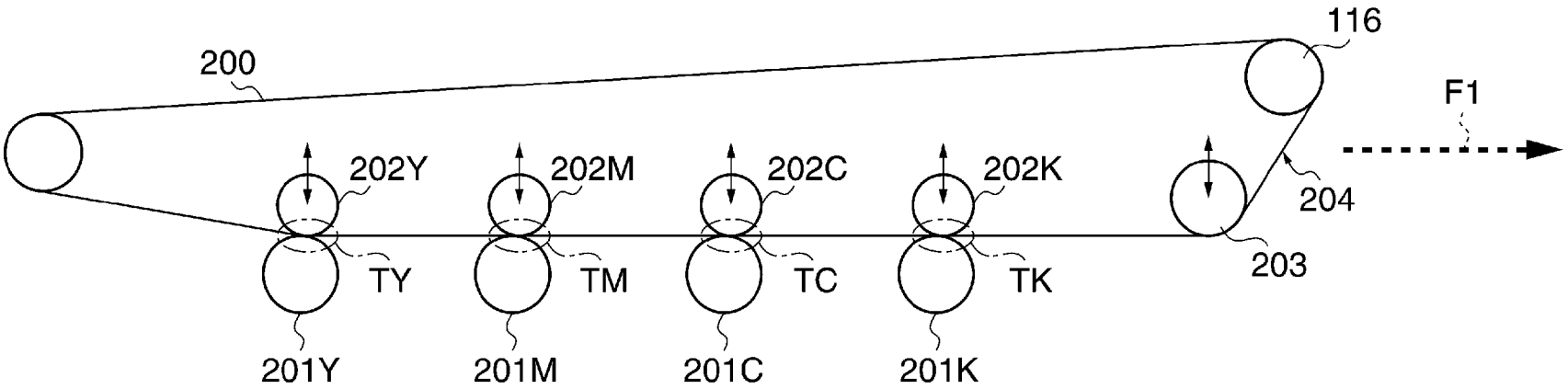
FIG. 4 is a view of the intermediate transfer belt unit and the photosensitive drums in the full abutment state as seen from the directions of the rotary shafts of the photosensitive drums.

FIG. 4 is a view of the intermediate transfer belt unit 204 and the photosensitive drums 201 as seen from the directions of the rotary shafts of the photosensitive drums 201.

The intermediate transfer belt unit 204 can be taken out by pulling it out in a direction indicated by an arrow F1 in FIG. 4 from the apparatus main body. The direction indicated by the arrow F1 is vertical to axes of the rotary shafts of the photosensitive drums 201 and parallel to a belt conveying direction across the photosensitive drums 201K to 201Y. At the time of mounting the intermediate transfer belt unit 204, it is moved in a direction opposite to the direction indicated by the arrow F1.

Assume that at the time of taking out or mounting the intermediate transfer belt unit 204, the photosensitive drums 201 are in the full abutment state as shown in FIG. 4. In this case, in areas TY, TM, TC, and TK where the intermediate transfer belt 200 and the photosensitive drums 201 are in abutment with each other, friction is generated between the intermediate transfer belt 200 and the photosensitive drums 201, causing deterioration thereof due to scratches or the like.

Figure 5A:
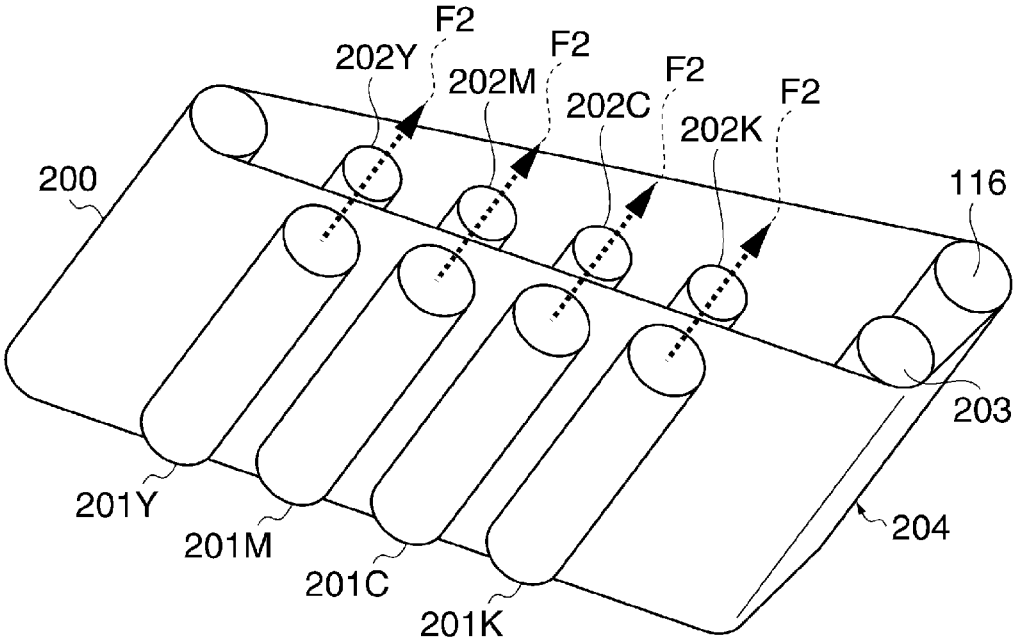
FIG. 5A is a perspective view of the intermediate transfer belt unit and the photosensitive drums in the full abutment state as seen from below.
Figure 5B:
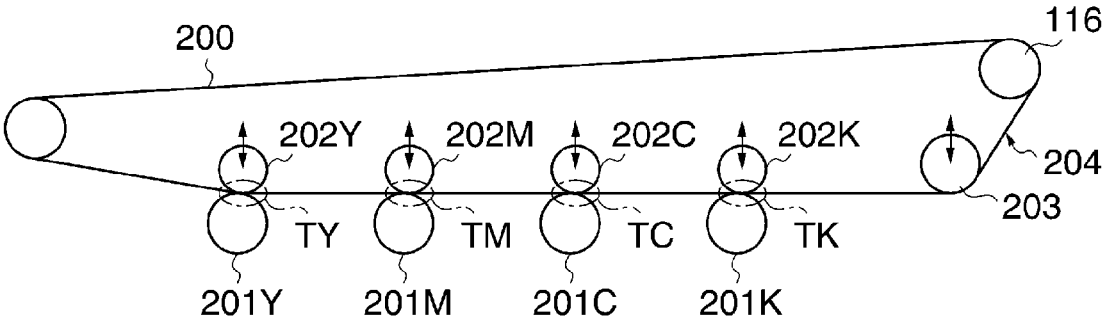
FIG. 5B is a view of the photosensitive drums as seen from the directions of the rotary shafts of the photosensitive drums.

FIG. 5A is a perspective view of the intermediate transfer belt unit 204 and the photosensitive drums 201 in the full abutment state as seen from below, and FIG. 5B is a view of the photosensitive drums 201 as seen from the directions of the rotary shafts of the photosensitive drums 201.

The photosensitive drums 201 can be taken out by pulling them out of the apparatus main body in directions indicated by arrows F2 in FIG. 5A. The directions indicated by the arrows F2 in FIG. 5A are directions of axes of the rotary shafts of the photosensitive drums 201. At the time of mounting the photosensitive drums 201, they are moved in directions opposite to the directions indicated by the arrows F2.

Assume that at the time of taking out or mounting the photosensitive drums 201, they are in the full abutment state as shown in FIG. 5B. In this case, in areas TY, TM, TC, and TK where the intermediate transfer belt 200 and the photosensitive drums 201 are in abutment with each other, friction is generated between the intermediate transfer belt 200 and the photosensitive drums 201, causing deterioration thereof due to scratches or the like.

FIG. 6 is a diagram showing the correspondence relationship between the operating state of the image forming apparatus 100 and the state of the photosensitive drums 201 (or the primary transfer rollers 202) being in abutment with and separate from the intermediate transfer belt 200.

As for the abutment/separation states, not the photosensitive drums 201 but the primary transfer rollers 202 are actually displaced, but the abutment relationship with the intermediate transfer belt 200 presents problems for the photosensitive drums 201. Therefore, in the present specification, when description is given of the abutment/separation states, the expression of "abutment and separation states of the photosensitive drums 201" is used with attention focused on the photosensitive drums 201.

In the present embodiment, the photosensitive drums 201 are selectively brought into the abutment state and the separation state according to whether the apparatus is in a standby state of waiting for a print job or is forming an image and also according to whether or not a monochrome image or a color image is to be formed. Additionally, the photosensitive drums 201 are selectively brought into the abutment state and the separation state according to whether or not it has become necessary to replace the intermediate transfer belt 200 or at least one of the photosensitive drums 201.

Specifically, referring to FIG. 6, the photosensitive drums 201 are selectively brought into the abutment state or the separation state according to whether the image forming apparatus 100 after power-on is at a normal time, a time of replacement when the time for replacement of the intermediate transfer belt 200 or the photosensitive drums 201 has come, or at an abnormal time when some abnormality has occurred. The normal time is a time other than the time at which the time for replacement has come and the abnormal time.

The time of standby is a time when a print job is waited for. This means the time when a monochrome image is being formed in a case where a monochrome job is executed, and the time when a color image is being formed in a case where a color job is executed.

First, when the image forming apparatus 100 is at any of the normal time, the time when the time for replacement has come, and the abnormal time, the photosensitive drums 201 are brought into the one-color abutment state when a monochrome image is to be formed, and brought into the full abutment state when a color image is to be formed.

When the image forming apparatus 100 is on standby at the normal time, the photosensitive drums 201 are brought into the one-color abutment state or the full-color abutment state. In this case, with reduction of downtime at the start of image formation in mind, whether the photosensitive drums 201 are brought into the one-color abutment state or the full-color abutment state should be determined, and this determination may arbitrarily made by the user. For example, when a case where monochrome image formation is mainly performed is imagined (when monochrome takes priority), the photosensitive drums 201 are brought into the one-color abutment state, and when a case where color image formation is mainly performed is imagined (when color takes priority), the photosensitive drums 201 are brought into the full-color abutment state.

On the other hand, when the image forming apparatus 100 is on standby at the time when the time for replacement has come or at the abnormal time, the photosensitive drums 201 are brought into the full separation state. At the time when time for replacement has come or at the abnormal time, the intermediate transfer belt 200 or one of the photosensitive drums 201 is likely to be replaced. Therefore, by bringing the intermediate transfer belt 200 and the photosensitive drums 201 out of engagement with each other, friction between them at the time of replacement can be prevented.

Figure 7:
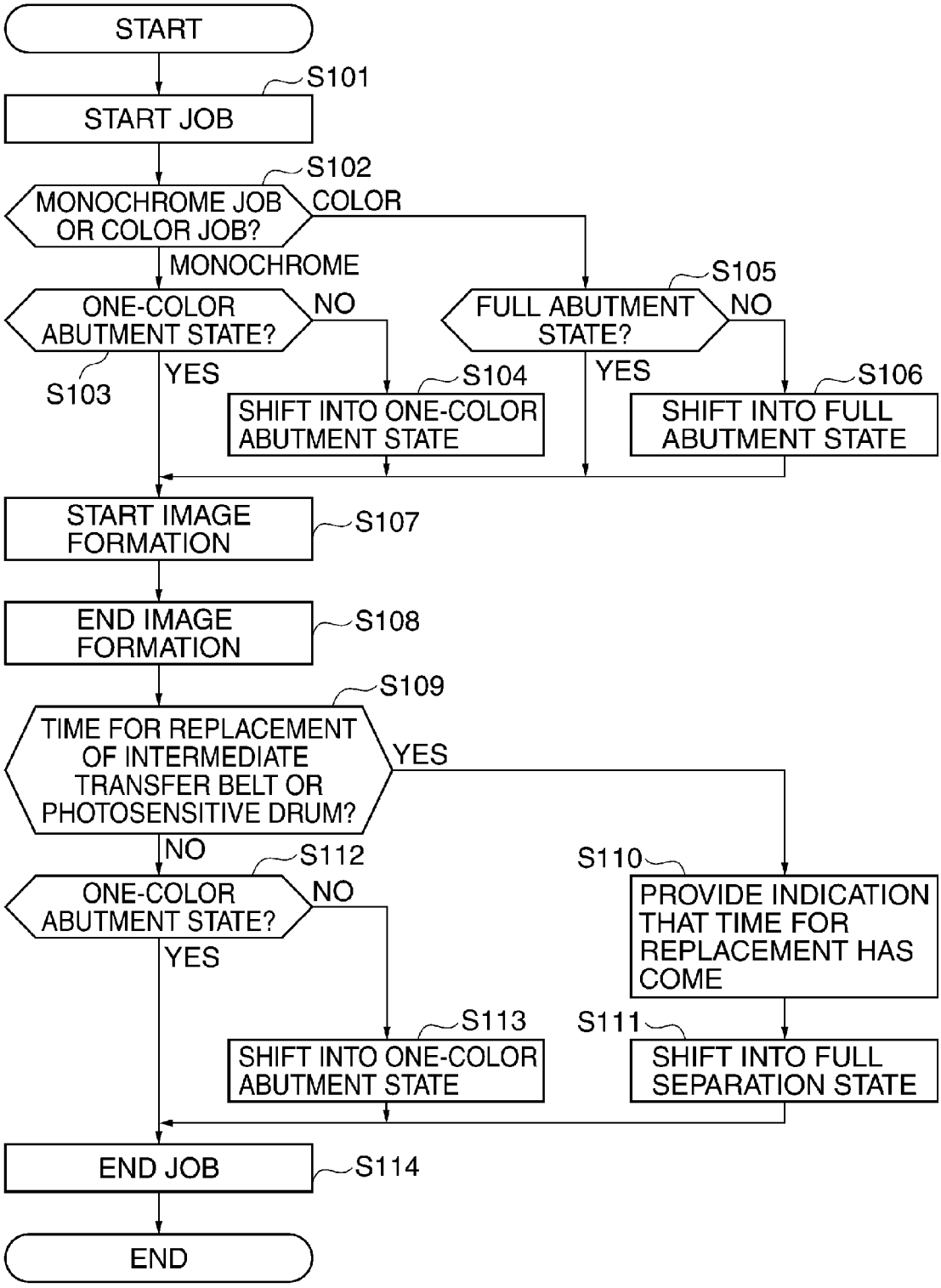
FIG. 7 is a flowchart of a process in which control is performed to selectively bring the photosensitive drums into the abutment state or the separation state according to whether or not the time for replacement has come.
Figure 8:
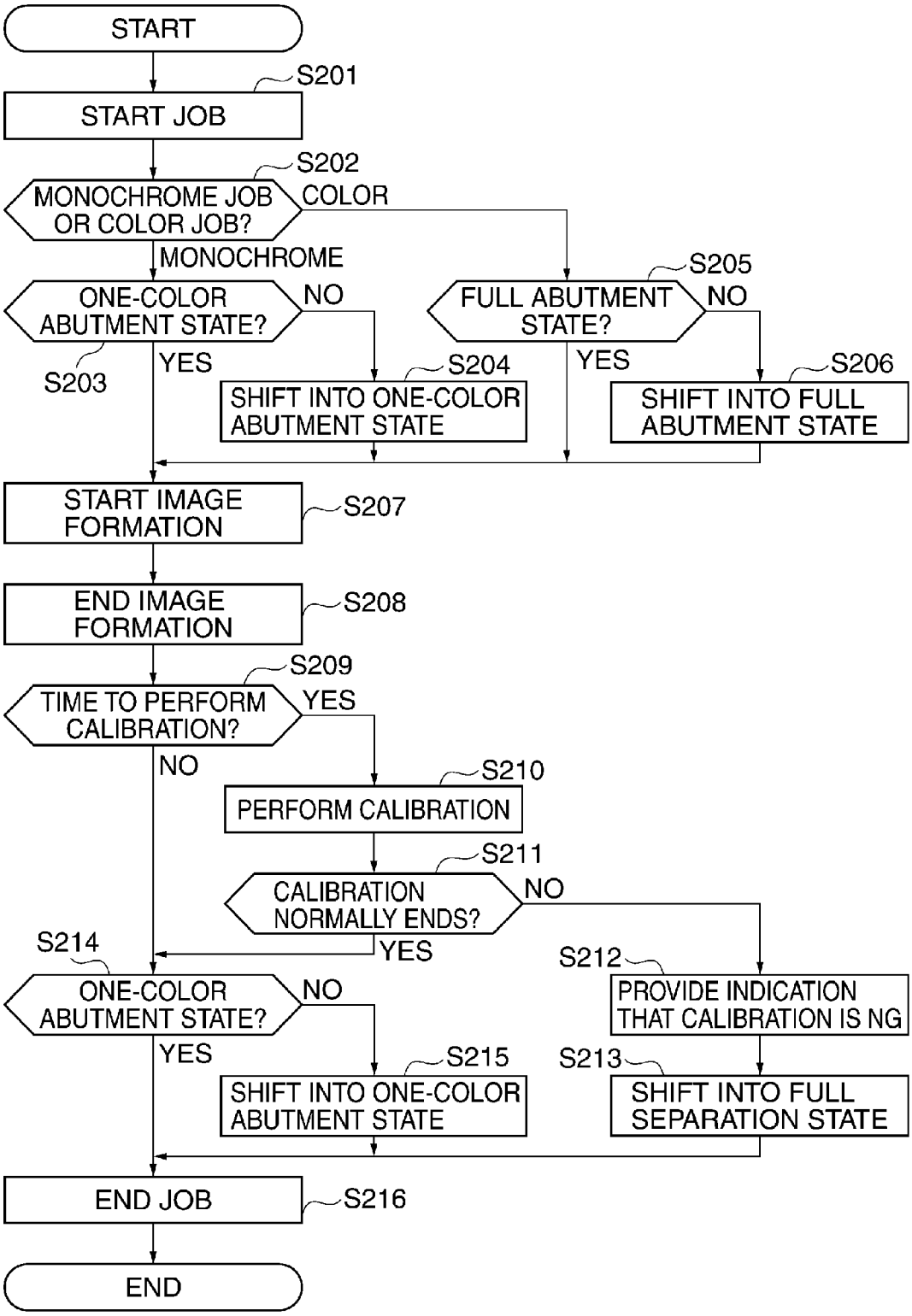
FIG. 8 is a flowchart of a process in which control is performed to selectively bring the photosensitive drums into the abutment state or the separation state according to whether or not a trouble has occurred.

Among the types of control to bring the photosensitive drums 201 into the full separation state, control performed when the time for replacement has come can be realized by a process in FIG. 7, and control performed when some trouble has occurred can be realized by a process in FIG. 8. First, a description will be given of the process in FIG. 7.

FIG. 7 is a flowchart of the process in which the photosensitive drums 201 are selectively brought into the abutment state or the separation state according to whether or not the time for replacement has come. This process is started by turning on the power to the image forming apparatus 100.

First, when an instruction to execute a job (print job) is issued, the CPU 601 starts the job in step S101, and determines in step S102 whether or not the job is a monochrome job or a color job.

When the started job is a monochrome job, the CPU 601 determines whether or not the photosensitive drums 201 are currently in the one-color abutment state based on a signal from the one-turn separation detecting sensor 606 (step S103). When the CPU 601 determines that the photosensitive drums 201 are in the one-color abutment state, the process proceeds to step S107. On the other hand, when the photosensitive drums 201 are not in the one-color abutment state, the CPU 601 brings the photosensitive drums 201 into the one-color abutment state by driving the one-turn separation motor 604 (step S104), and then the process proceeds to the step S107.

On the other hand, when, as a result of the determination in the step S102, the started job is a color job, the CPU 601 determines whether or not the photosensitive drums 201 are currently in the full abutment state (step S105). When the CPU 601 determines that the photosensitive drums 201 are in the full abutment state, the process proceeds to the step S107. On the other hand, when the photosensitive drums 201 are not in the full abutment state, the CPU 601 brings the photosensitive drums 201 into the full abutment state by driving the one-turn separation motor 604 (step S106), and then the process proceeds to the step S107. The CPU 601 starts image formation in the step S107 and ends image formation in step S108.

Next, in step S109, the CPU 601 determines whether or not the time for replacement has come for the intermediate transfer belt 200 or at least one of the photosensitive drums 201. On this occasion, the determination may be made individually for each of the photosensitive drums 201. This determination is made by, for example, counting the total number of pages that have been printed since the image forming apparatus 100 was installed for the first time or the total number of pages that have been printed since the intermediate transfer belt 200 or one of the photosensitive drums 201 was replaced last, and determining whether or not the value has become equal to or greater than a predetermined value.

When the CPU 601 determines in the step S109 that the time for replacement has not come for the intermediate transfer belt 200 or the photosensitive drums 201, the process proceeds to step S112. In the step S112, based on a signal from the one-turn separation detecting sensor 606, the CPU 601 determines whether or not the photosensitive drums 201 are currently in the one-color abutment state. When the CPU 601 determines that the photosensitive drums 201 are in the one-color abutment state, the process proceeds to step S114. On the other hand, when the photosensitive drums 201 are not in the one-color abutment state, the CPU 601 brings the photosensitive drums 201 into the one-color abutment state by driving the one-turn separation motor 604 (step S113), and then the process proceeds to the step S114.

On the other hand, when, as a result of the determination in the step S109, the time for replacement has come for the intermediate transfer belt 200 or at least one of the photosensitive drums 201, the CPU 601 notifies a user to that effect by providing an indication on the display unit 610 (FIG. 2) (step S110). At the same time, the CPU 601 brings the photosensitive drums 201 into the full separation state by driving the one-turn separation motor 604 (step S111), and then the process proceeds to the step S114.

In the step S114, the CPU 601 brings the apparatus into a standby state by ending the job. Thus, after image formation ends, when the time for replacement has come for the intermediate transfer belt 200 or at least one of the photosensitive drums 201, the photosensitive drums 201 are brought into the full separation state and then into the standby state.

When the time for replacement has come, it can be considered that the intermediate transfer belt 200 or the photosensitive drum 201 is likely to be replaced soon by the user because it has reached the end of its useful life. Moreover, because the notification that the time for replacement has come has been provided, this is more likely to occur. Accordingly, in this case, the apparatus stands by in the full separation state after image formation ends. Namely, when replacement is likely to occur at the time of shifting into the standby state, the intermediate transfer belt 200 and the photosensitive drums 201 are held in the separation state, so that the intermediate transfer belt 200 or one of the photosensitive drums 201 can be prevented from being replaced in a state where the intermediate transfer belt 200 and the photosensitive drums 201 are in contact with each other. As a result, generation of friction between the intermediate transfer belt 200 and the photosensitive drums 201 can be prevented at the time of replacement.

On the other hand, when the time for replacement has not come for the intermediate transfer belt 200 or the photosensitive drums 201, the CPU 601 brings the photosensitive drums 201 into the one-color abutment state and stands by, thereby eliminating the need for an abutment operation particularly at the start of forming a monochrome image and reducing downtime.

It should be noted that in the step S109, whether or not it is necessary to replace the intermediate transfer belt 200 or one of the photosensitive drums 201 may be determined not only based on the number of printed pages as illustrated above, but also by estimating the ends of their useful lives using another method. For example, a video count value may be compared with a predetermined setting value so as to make a determination based on toner consumption. Alternatively, the total number of rotations of the intermediate transfer belt 200 and the photosensitive drums 201 may be recorded in advance, and they may be compared with a predetermined setting value. Still alternatively, a change in electric current which is passed through the intermediate transfer belt unit 204 so as to rotatively drive the intermediate transfer belt unit 204 may be detected to determine the end of its useful life.

FIG. 8 is a flowchart of the process in which control is performed to bring the photosensitive drums 201 into the abutment/separation state according to whether or not a trouble has occurred.

First, in steps S201 to S208, the CPU 601 performs the same processes as those in the steps S101 to S108 in FIG. 7.

When image formation ends, the CPU 601 determines in step S209 whether or not the time to perform a calibration has come. This determination is made according to, for example, whether or not the total number of pages that have been printed since the last calibration was performed is equal to or greater than a predetermined number set in advance. When the total number of pages that have been printed is equal to or greater than the predetermined number, it can be determined that it is necessary to correct image forming conditions, and as a result, it can be determined that the time to perform a calibration has come.

Here, a calibration means control to, when a status of the apparatus main body has changed, detect the status and optimize image forming conditions according to the detection result. In the present embodiment, control to correct density is performed every time a predetermined number of pages have been printed is imagined as an exemplary calibration. Specifically, based on a detection result obtained by the photosensor 140 (FIG. 1) detecting an image formed on the intermediate transfer belt 200, the CPU 601 performs control to optimize image forming conditions such as the amount of replenishing toner and the amount of laser light to be emitted from the laser exposure device 108 (FIG. 1).

When the CPU 601 determines in the step S209 that the time to perform a calibration has not come, the process proceeds to step S214. On the other hand, when the time to perform a calibration has come, the CPU 601 performs a calibration (step S210) and determines whether or not the calibration has been successfully completed (step S211).

When, as a result of the determination, the calibration has been successfully completed, it can be determined that no trouble has occurred, and therefore, the process proceeds to the step S214. On the other hand, when the calibration has not been successfully completed, the CPU 601 notifies the user to that effect by providing an indication on the display unit 610 (FIG. 2) (step S212). At the same time, the CPU 601 brings the photosensitive drums 201 into the full separation state by driving the one-turn separation motor 604 (step S213), and then the process proceeds to step S216.

In steps S214, S215, and S216, the CPU 601 performs the same processes as those in the steps S112, S113, and S114 in FIG. 7.

As described above, when calibration has not been successfully completed, it can be considered that a trouble has occurred, and the intermediate transfer belt 200 or one of the photosensitive drums 201 is likely to be replaced soon by the user. Moreover, because the notification that the time for replacement has come has been provided, this is more likely to occur. Accordingly, in this case, the apparatus stands by in the full separation state after image formation ends. Namely, when replacement is likely to occur at the time of shifting into the standby state, the intermediate transfer belt 200 and the photosensitive drums 201 are kept separate from each other, so that the intermediate transfer belt 200 or one of the photosensitive drums 201 can be prevented from being replaced in a state where the intermediate transfer belt 200 and the photosensitive drums 201 are in contact with each other. As a result, generation of friction between the intermediate transfer belt 200 and the photosensitive drums 201 can be prevented at the time of replacement.

On the other hand, when the calibration has been successfully completed, the apparatus stands by with the photosensitive drums 201 held in the one-color abutment state, thereby eliminating the need for an abutment operation particularly at the start of forming a monochrome image and reducing downtime.

Thus, according to the present invention, while downtime is reduced, generation of friction between the intermediate transfer belt 200 and the photosensitive drums 201 due to replacement of the intermediate transfer belt 200 or one of the photosensitive drums 201 can be prevented, and damage to both of them can be prevented to maintain both of them in desirable conditions.

As examples of determinations as to whether or not to it is necessary to replace the intermediate transfer belt 200 or one of the photosensitive drums 201, a determination as to whether or not the time for replacement has come is illustrated in FIG. 7, and a determination as to whether or not a trouble has occurred based on a result of calibration is illustrated in FIG. 8. Only one of these processes in FIGS. 7 and 8 may be adopted, but it is preferred that both of them are adopted. Namely, it is preferred that both whether or not the time for replacement has come and whether or not a trouble has occurred are checked, and when replacement becomes necessary due to one of the causes, the full separation state during standby is realized.

Accordingly, a substantial combination of the processes in FIGS. 7 and 8 is adopted. Specifically, the process in FIG. 7 is adopted, and also, processes corresponding to those in the steps S209 to S215 in FIG. 8 are inserted immediately before the step S114 in FIG. 7.

It should be noted that in the steps S112 and S113 in FIG. 7 and the steps S214 and S215 in FIG. 8, a mechanism for waiting in the one-color abutment state during standby with reduction of downtime during execution of a monochrome job in mind. The present invention, however, is not limited to this, but the apparatus may wait in the full abutment state during standby with reduction of downtime during execution of a color job in mind. In this case, in the steps S112 and S113 in FIG. 7 and the steps S214 and S215 in FIG. 8, the CPU 601 should determine whether or not the apparatus is in the full abutment state, and when the apparatus is not in the full abutment state, the CPU 601 should perform control such that the apparatus shifts into the full abutment state.

It should be noted that the present invention may be applied to any image forming apparatus as long as the intermediate transfer belt 200 or one of the photosensitive drums 201 is replaceable. Moreover, the intermediate transfer belt 200 may be replaced alone or replaced as the intermediate transfer belt unit 204, and the photosensitive drums 201 may be replaced alone or replaced as the process cartridges 103.

It should be noted that although in the above description, there is a plurality of photosensitive drums 201, the present invention may be applied to any image forming apparatus having only one photosensitive drum 201 from the viewpoint of preventing generation of friction between the intermediate transfer belt 200 and the photosensitive drums 201 when the intermediate transfer belt 200 or one of the photosensitive drums 201 is replaced.

It should be noted that a notification that the time for replacement has come or a trouble has occurred (the step S110 in FIG. 7 and the step S212 in FIG. 8) preferably encourages replacement. The form of the notification, however, is not limited to displaying, but may be generation of sound or the like.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-274576 filed Dec. 17, 2012, which is hereby incorporated by reference herein in its entirety.

What is claimed is:

1. An image forming apparatus comprising:

a photosensitive drum;

an image forming unit configured to form an image on the photosensitive drum;

an intermediate transfer belt;

a transfer unit configured to transfer the image formed on the photosensitive drum to the intermediate transfer belt, and transfer the image on the intermediate transfer belt to a recording medium;

a determination unit configured to determine whether the photosensitive drum should be replaced based on usage conditions of the photosensitive drum;

a notification unit configured to notify that the photosensitive drum should be replaced in a case where the determination unit determines that the photosensitive drum should be replaced; and a separation unit configured to perform a separating operation for separating the intermediate transfer belt from the photosensitive drum, wherein, in a case where the determination unit determines that the photosensitive drum should be replaced, the separation unit is configured to perform the separating operation after the image on the intermediate transfer belt is transferred to the recording medium by the transfer unit, wherein, in a case where the determination unit does not determine that the photosensitive drum should be replaced, the separation unit is configured to not perform the separating operation, and wherein, in a case where the determination unit determines that the photosensitive drum should be replaced while the image forming unit continuously forms a plurality of images, the separation unit is configured to perform the separating operation after the plurality of images are transferred to the recording mediums by the transfer unit.

2. An image forming apparatus comprising:

a photosensitive drum;

an image forming unit configured to form an image on the photosensitive drum;

an intermediate transfer belt;

a transfer unit configured to transfer the image formed on the photosensitive drum to the intermediate transfer belt, and transfer the image on the intermediate transfer belt to a recording medium;

a determination unit configured to determine whether the photosensitive drum should be replaced based on usage conditions of the photosensitive drum;

a notification unit configured to notify that the photosensitive drum should be replaced in a case where the determination unit determines that the photosensitive drum should be replaced; and a separation unit configured to perform a separating operation for separating the intermediate transfer belt from the photosensitive drum, wherein, in a case where the determination unit determines that the photosensitive drum should be replaced, the separation unit is configured to perform the separating operation after the image on the intermediate transfer belt is transferred to the recording medium by the transfer unit, wherein, in a case where the determination unit does not determine that the photosensitive drum should be replaced, the separation unit is configured to not perform the separating operation, and wherein, in a case where the determination unit determines that the photosensitive drum should be replaced, the separation unit is configured to perform the separating operation after a predetermined time period has elapsed since the image on the intermediate transfer belt was transferred to the recording medium by the transfer unit.

3. The image forming apparatus according to claim 1, wherein:

the photosensitive drum is a first photosensitive drum on which a first image is to be formed, the image forming apparatus further comprises a second photosensitive drum on which a second image is to be formed, wherein a color of the second image is different from a color of the first image, wherein the determination unit is configured to determine whether one of the first photosensitive drum or the second photosensitive drum should be replaced, and wherein, in a case where the determination unit determines that neither the first photosensitive drum nor the second photosensitive drum should be replaced, the intermediate transfer belt comes into a state of being in abutment with the first photosensitive drum and not in abutment with the second photosensitive drum after the image on the intermediate transfer belt is transferred to the recording medium by the transfer unit.

4. The image forming apparatus according to claim 3, wherein the color of the first image is black, wherein the determination unit is configured to determine whether one of the first photosensitive drum or the second photosensitive drum should be replaced, wherein, in a case where the determination unit determines that neither the first photosensitive drum nor the second photosensitive drum should be replaced, and in a case where a monochrome image is to be formed after a color image is formed by the image forming unit, the intermediate transfer belt becomes a first state of being in abutment with the first photosensitive drum and not in abutment with the second photosensitive drum after the color image on the intermediate transfer belt is transferred to the recording medium by the transfer unit, and wherein, in a case where the determination unit determines that neither the first photosensitive drum nor the second photosensitive drum should be replaced, and in a case where the color image is to be formed after the monochrome image is formed by the image forming unit, the intermediate transfer belt becomes a second state of being in abutment with the first photosensitive drum and the second photosensitive drum after the monochrome image on the intermediate transfer belt was transferred to the recording medium by the transfer unit.

5. The image forming apparatus according to claim 1, wherein the determination unit is configured to determine whether the photosensitive drum should be replaced based on a total number of rotation of the photosensitive drum.

6. The image forming apparatus according to claim 5, wherein, if the total number of rotation of the photosensitive drum exceeds a predetermined number, the determination unit is configured to determine whether the photosensitive drum should be replaced.

7. An image forming apparatus comprising:

a photosensitive drum;

an image forming unit configured to form an image on the photosensitive drum;

an intermediate transfer belt;

a transfer unit configured to transfer the image formed on the photosensitive drum to the intermediate transfer belt, and transfer the image on the intermediate transfer belt to a recording medium;

a determination unit configured to determine whether the photosensitive drum should be replaced based on usage conditions of the photosensitive drum;

a notification unit configured to notify that the photosensitive drum should be replaced in a case where the determination unit determines that the photosensitive drum should be replaced; and a separation unit configured to perform a separating operation for separating the intermediate transfer belt from the photosensitive drum, wherein, in a case where the determination unit determines that the photosensitive drum should be replaced, the separation unit is configured to perform the separating operation after the image on the intermediate transfer belt is transferred to the recording medium by the transfer unit, wherein, in a case where the determination unit does not determine that the photosensitive drum should be replaced, the separation unit is configured to not perform the separating operation, and wherein the determination unit is configured to determine whether the photosensitive drum should be replaced based on a total time period in which the photosensitive drum rotates.

8. The image forming apparatus according to claim 7, wherein, if the total time period for which the photosensitive drum rotates exceeds a predetermined time period, the determination unit is configured to determine whether the photosensitive drum should be replaced.

9. The image forming apparatus according to claim 1, further comprising:

a detection unit configured to detect an abnormality in the image forming apparatus, wherein, if the detection unit detected the abnormality, the separation unit performs the separating operation regardless of a result of determination by the determination unit.

10. The image forming apparatus according to claim 9, wherein the abnormality is a trouble that occurs while a calibration is being performed in the image forming apparatus.

11. The image forming apparatus according to claim 10, further comprising another determination unit configured to determine whether the calibration should be performed.

12. The image forming apparatus according to claim 11, wherein based on a total number of pages that have been printed since the last calibration was performed, the another determination unit determines whether the calibration should be performed.

13. The image forming apparatus according to claim 1, wherein:

the photosensitive drum includes a plurality of the photosensitive drums, and in a case where the determination unit determines that the photosensitive drum should be replaced, the separation unit separates all of the plurality of photosensitive drums from the intermediate transfer belt.

* * * * *